US010642225B2

(12) United States Patent
Organ

(10) Patent No.: US 10,642,225 B2
(45) Date of Patent: May 5, 2020

(54) REFLECTING SUNDIAL

(71) Applicant: Donald Vick Organ, Saratoga, CA (US)

(72) Inventor: Donald Vick Organ, Saratoga, CA (US)

( * ) Notice: Subject to any disclaimer, the term of this patent is extended or adjusted under 35 U.S.C. 154(b) by 298 days.

(21) Appl. No.: 15/810,086

(22) Filed: Nov. 12, 2017

(65) Prior Publication Data

US 2019/0146419 A1 May 16, 2019

(51) Int. Cl.
*G04B 49/04* (2006.01)

(52) U.S. Cl.
CPC ..... *G04B 49/04* (2013.01)

(58) Field of Classification Search
CPC ..... G04B 49/00; G04B 49/04
USPC ..... 33/228, 269
See application file for complete search history.

(56) References Cited

U.S. PATENT DOCUMENTS

| | | | | | |
|---|---|---|---|---|---|
| 3,815,249 | A * | 6/1974 | Gundlach | G04B 49/00 | 33/269 |
| 4,845,853 | A * | 7/1989 | Haskett | G04B 49/02 | 33/270 |
| 5,197,199 | A * | 3/1993 | Shrader | G04B 49/02 | 33/269 |
| 5,365,498 | A * | 11/1994 | Lazanyi | G04B 19/00 | 368/239 |
| 6,009,628 | A * | 1/2000 | Mizushima | G04B 49/02 | 33/270 |
| 9,727,025 | B1 * | 8/2017 | Rupert | G04B 49/02 | |
| 2009/0044417 | A1 * | 2/2009 | Chen | G01C 17/34 | 33/269 |
| 2019/0146419 | A1 * | 5/2019 | Organ | G04B 49/04 | |

* cited by examiner

*Primary Examiner* — Yaritza Guadalupe-McCall

(57) ABSTRACT

In one embodiment, a reflecting surface, a gnomon and a dial are arranged so that rays from the sun are reflected toward gnomon such that its projected image is visible on dial. The projected image moves across the dial in response to the movement of sun across the sky, thus providing some indication of time and season. Other embodiments are described and shown.

16 Claims, 7 Drawing Sheets

REFLECTING SUNDIAL

TECHNICAL FIELD

This present invention relates to architecture, including commercial, residential, monumental and landscape architecture, and more specifically to the ornamentation of architecture with the addition of one or more visible highlights that couple the architecture with time or season or both.

BACKGROUND

Prior Art

The following is a tabulation of some prior art that presently appears relevant:

| U.S. Patents | | | |
|---|---|---|---|
| Pat. No. | Kind Code | Publication Date | Inventor |
| 5,197,199 "Reflected Spot Sundial" | B1 | Mar. 30, 1993 | Shrader |
| 8,387,265 "Sundial" | B2 | Mar. 5, 2013 | Popendorf |

| Nonpatent Literature Documents |
|---|
| Daylighting Natural Light in Architecture, ISBN 0750663235, Derek Phillips, Architectural Press, 2004 (https://www.slideshare.net/WezzySaid/daylighting-natural-light-in-architecture) |
| Light-A Natural Ornamental Element in Islamic Architecture! (http://www.archilovers.com/stories/8534/light-a-natural-ornamental-element-in-islamic-architecture.html) Author: (not identified) |
| Classic Sundials: Large number of publications, including: "Sundials" ISBN 13: 978-0-7112-2494-0 Mark Lennox-Boyd 2006. |
| http://www.illustratingshadows.com/reflecting-dials.pdf (Illustrating Shadows) Author: (not identified) |
| https://www.qwerty.co.za/sundials/types/ceiling.html Author: Helga Nordhoff |
| http://www.improbable.com/2012/10/25/egans-indoor-sundial-and-its-quasicompetitors/ Author: Tom Egan |

Architectural works often contain ornamental features intended to add interest and draw the observer's eye to a particular aspect. Natural light has been widely used, but normally for either lighting or for ornamental purposes that are at a lower elevation than the architectural feature (window) associated with the light. Phillip's "Daylighting Natural Light in Architecture" surveys many methods by which natural lighting may be incorporated into architecture. However, its mention of ornamental usage is limited to usage of hidden windows. "Light—A Natural Ornamental Element in Islamic Architecture!" surveys some ornamental usages of light in architecture, but is concerned mostly with Jaali structures (ornate screens placed in windows) and their orientation and ornamentation.

Sundials have long been used to add a time-of-day (or sometimes time-of-year) interest to an architectural work. The history of sundials is very long and includes countless variations. Most sundials produce the sun's shadow with a gnomon such that the shadow falls on a dial which often includes indicia. As such, the observable effect—the shadow—is usually visible in a location that is exposed to full sunshine, and with the shadow at an elevation somewhat below the gnomon. These constraints limit suitability of sundials in the architectural ornamentation, where the observer's eye is often drawn to features at a higher elevation in the architecture, and where a higher-yet gnomon could be costly and considered a distraction.

The "Reflected Spot Sundial" of Shrader and the "reflected ceiling dials" of Nordhoff, escape these constraints by allowing the sun's reflection to be cast over a distance and with little constraint of the relative location of the dial to the mirror. However they have a limitation on the mirror configuration—the mirror must be appropriately small to reflect a distinct spot. A larger mirror enlarges the spot into an indistinct area of high intensity such that the precision of the spot is lost. Further, the path of the reflected spot across the dial follows from simple geometry of the sun's location, the mirror's location and orientation as well as the dial's location and orientation. Thus the sun's reflected spot will move across the dial such that it may be visible for a small portion of the day. The spot also has a large degree of movement through the seasons of the year as the sun moves northward and southward. Thus the span of areas illuminated on the dial may be very large relative to the architectural designer's desires. Further, many configurations of Nordhoffs reflected ceiling dial position the mirror such that the sun's reflection may be cast upon occupants of the room.

Egan's approach of using a curved mirror and a pinhole camera obscura offers the advantage that the curved mirror allows the sun to be more easily tracked for a longer period and without requiring a corresponding larger dial. Unfortunately, the camera obscura is dim and therefore not generally suitable for architectural ornamentation. Popendorf's "Sundial" reflects an image of the sun to a connected dial-face. As such it is not generally suitable for separation of the dial-face from the reflecting surface, and thus is less suitable for architectural ornamentation.

None of the aforementioned approaches are conducive to projecting a bright image over a distance, with movement controllable by the architectural designer and in an arbitrary configuration—such as with the projected image at a higher elevation on the architectural work.

SUMMARY OF THE INVENTION

The inventive subject matter provides apparatus, systems and methods in which an image or a highlight may be projected onto a wall or other architectural feature using reflected light from the sun. This image's movement throughout the day, and at the same time of day, day to day throughout the year, conveys an indication of time and season by the position of the image on the wall.

The sun's light is reflected off of a surface such as a curved mirror to a gnomon which blocks or filters some light so the resulting light creates an image of the gnomon when it strikes a wall beyond the gnomon.

The architectural designer controls all aspects of this image and the image's movement across the wall, including brightness, sharpness, size, trajectory, effective period and rate of traversal. The architectural designer achieves this by controlling the location of the mirror relative to the wall, by controlling the composition, size, shape and orientation of the mirror, and by controlling the location of the gnomon. The image itself is controlled by the shape, size and design of the gnomon.

DRAWINGS—FIGURES

DRAWINGS—REFERENCE NUMERALS

Figure 1:
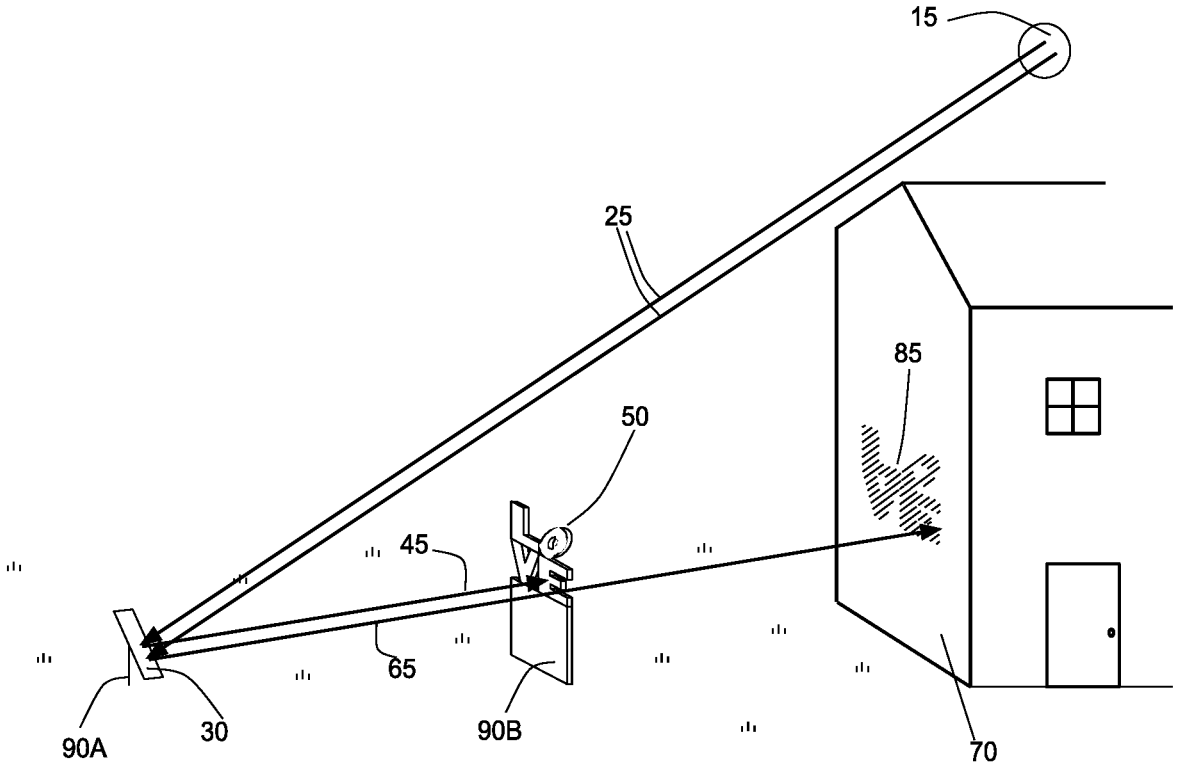
FIG. 1 shows the components of one embodiment of a reflecting sundial at a particular instant in time.

11 sun or moon at an earlier day
13 sun or moon at an earlier instant
15 sun or moon
17 sun or moon at a later instant
19 sun or moon at a later day
21 incident rays of light at an earlier day
23 incident rays of light at an earlier instant
25 incident rays of light
27 incident rays of light at a later instant
29 incident rays of light at a later day
30 reflecting surface
30D narrower reflecting surface
30E additional reflecting surface
30F additional reflecting surface
45 blocked reflected rays of light
50 gnomon
50F additional gnomon
61 reflected rays at an earlier day
63 reflected rays of light at an earlier instant
63D non-existent reflected ray at an earlier instant
65 unblocked reflected rays of light
65F unblocked reflected rays of light from additional reflecting surface
67 reflected rays of light at a later instant
67D non-existent reflected ray at a later instant
69 reflected rays of light at a later day
70 dial
81 projected image at an earlier day
83 projected image at an earlier instant
85 projected image
85F projected image from additional gnomon
87 projected image at a later instant
89 projected image at a later day
90A supporting structure for reflecting surface
90B supporting structure for gnomon

GLOSSARY

These are a few terms not sufficiently defined elsewhere in this specification.

Dial—in the field of sundials, the dial is the surface or apparatus on which the sun's shadow is visible. The dial may, or may not include indicia. For the purposes of this specification, a dial is any surface or object on which the projected image is visible.

Effective period—the period of time for which a projected image, formed by a single reflecting surface and a single gnomon, is observable on a particular dial. This may refer to duration within a particular day of the year. Or may refer to day-by-day throughout the seasons of the year.

Gnomon—in the field of sundials, the gnomon is the opaque object that casts the shadow. This definition is broadened for the purposes of this specification—to any object that alters light reflected by the reflecting surface. The gnomon may alter the light by blocking it. And the gnomon may alter the light be altering the color, or by altering the brightness.

Trajectory—the path of movement of the projected image across the dial. May refer to the path for a particular day, or may refer to the day-by-day movement throughout the year.

DETAILED DESCRIPTION—FIG. 1—FIRST EMBODIMENT

One embodiment is illustrated in FIG. 1. Incident rays of light 25 emanating from sun or moon 15 strike a reflecting surface 30 where they result in reflected rays 45, 65. Some of the reflected rays 45 will encounter gnomon 50 where they are blocked or otherwise altered. Other reflected rays 65 will continue to dial 70 where they, in contrast with the shadows from blocked rays 45, produce projected image 85. Mounting structures 90A, 90B fix the positions of the reflecting surface 30 and gnomon 50, respectively. Projected image 85 adds visible interest to an architectural feature, and will move in response to the movement of sun 15.

OPERATION—FIGS. 2A, 2B, 2C AND 2D—ALTERNATE EMBODIMENT

Other than sun 15, this present invention has no moving parts. It produces movement of image 85 on dial 70 as a result of the motion of sun 15 in the sky.

The positions of reflecting surface 30, gnomon 50, and dial 70 are fixed by any suitable means, these were shown as 90A, 90B in FIG. 1 only, but are removed from subsequent figures.

The embodiment illustrated in FIG. 2B to represent an instant of time somewhat earlier and then again somewhat later than the instant illustrated in FIG. 2A. The earlier instant is represented by sun or moon 13. It emanates incident rays 23 which results in reflected rays 63 that produces the image 83. For simplicity, this diagram does not represent the blocked rays 45 of FIG. 2A. Still on FIG. 2B, sun or moon at a later instant in time 17 emanates incident rays 27 which results in reflected rays 67 and produces image 87.

Figure 2A:
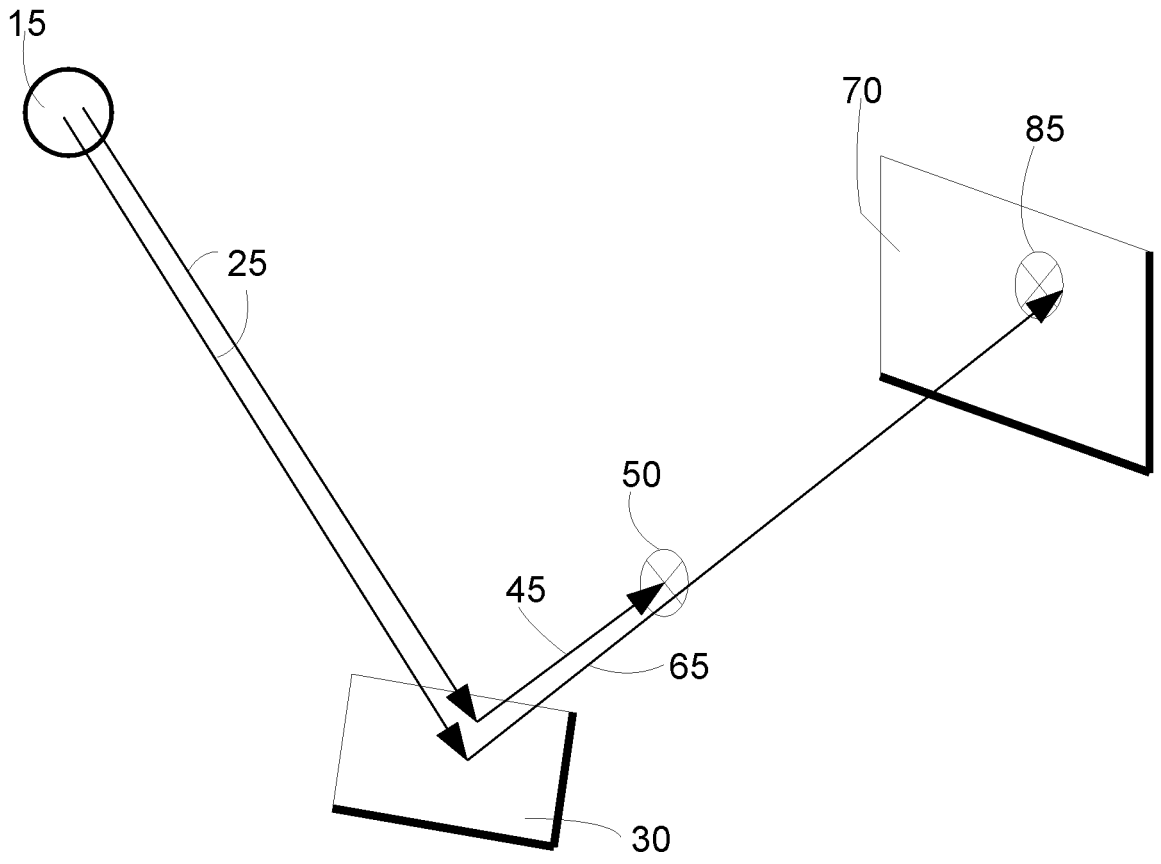
FIG. 2A shows an alternate embodiment with a different orientation of the reflecting surface, gnomon and dial, and simplified to better show the effect of the motion of the sun or moon across the sky.
Figure 2B:
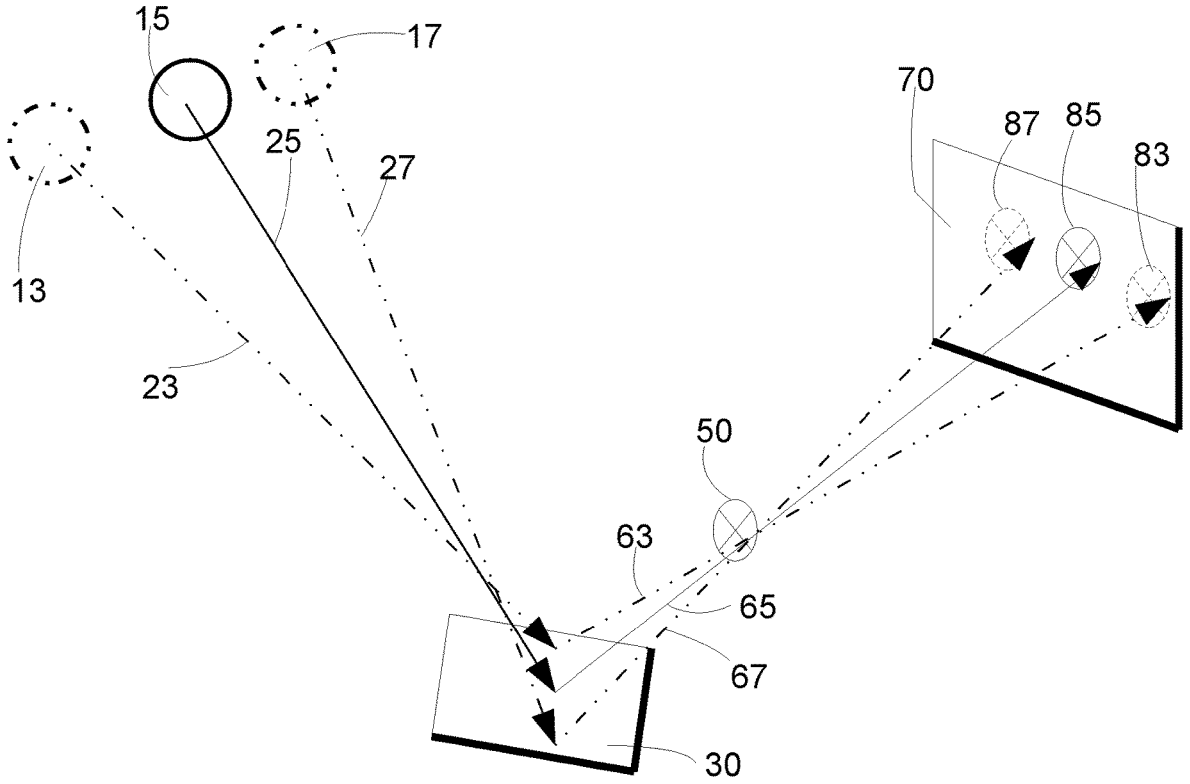
FIG. 2B shows a simplification of an alternate embodiment of FIG. 2A with the effects of the movement of the sun or moon on the same components at a few instants of time in a particular day.
Figure 2C:
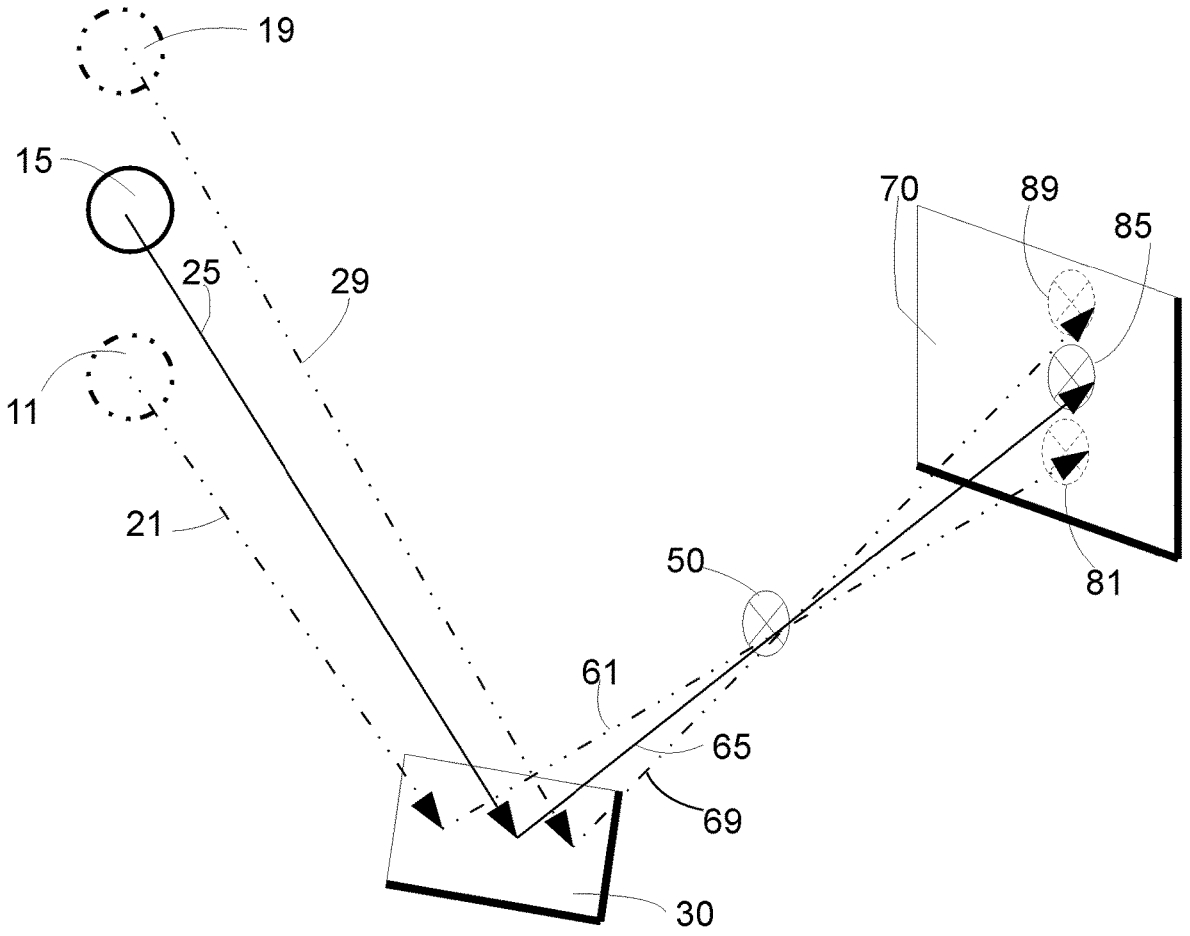
FIG. 2C shows the effects of the movement of the sun or moon on the same components at a few different days of the year, but all at the same time of day.

The same embodiment is illustrated in FIG. 2C to represent a date earlier and then again a date later than instant illustrated in FIG. 2A, all at the same time of day. The earlier date is represented by sun or moon 11. It emanates incident rays 21 which results in reflected rays 61 that produces image 81. For simplicity, this diagram does not represent the blocked rays 45 of FIG. 2A. Still on FIG. 2C, sun or moon 19 at a later instant in time emanates incident rays 29 which results in reflected rays 69 and produces image 89. For purposes of this specification, a "date earlier" shall mean "closer to the December solstice" and a "date later" shall mean "closer to the June solstice". Thus the sun will be higher in the sky in the Northern Hemisphere at a later date.

Figure 2D:
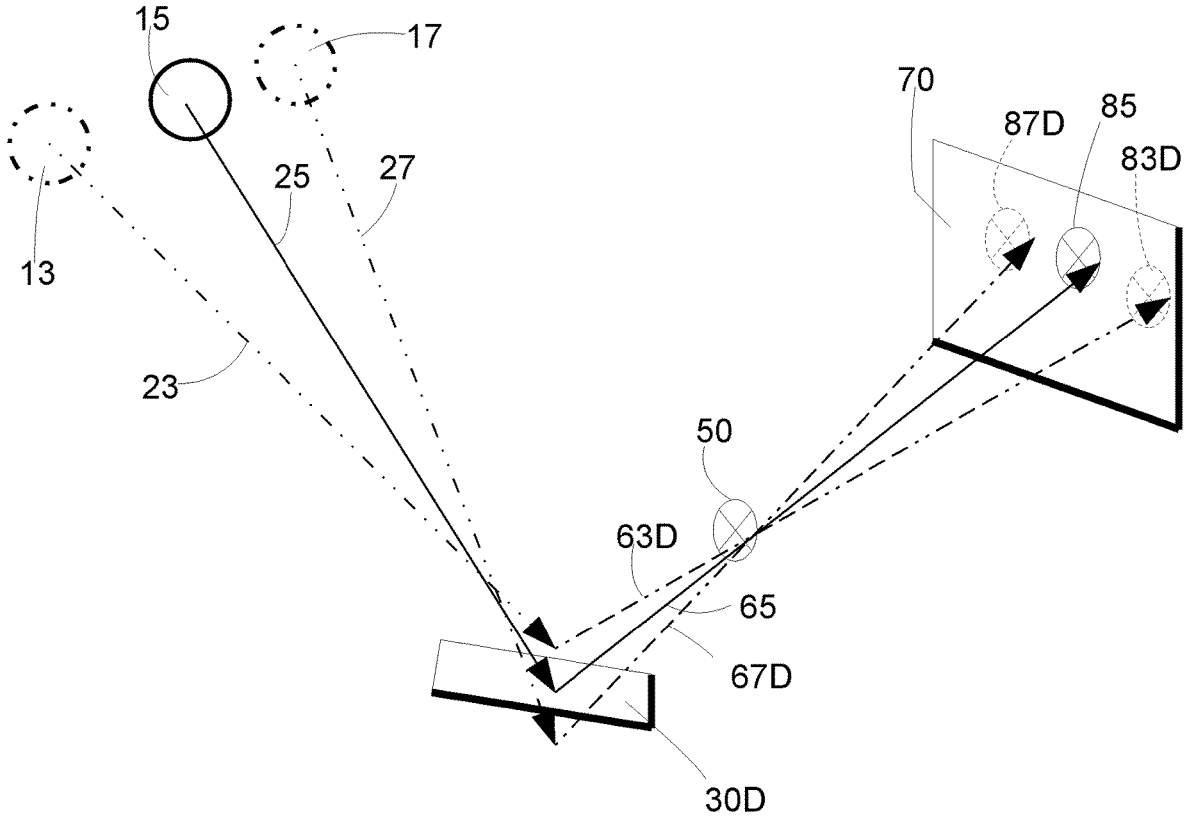
FIG. 2D is a variation of FIG. 2B to illustrate "effective period".

FIG. 2D is a variation of FIG. 28 to illustrate "effective period". Comparing FIG. 2D and FIG. 2B, reflecting surface 30D is narrower than reflecting surface 30. Thus, reflected rays 63D are not produced to correspond to reflected rays 63 of FIG. 2B. Thus, image 83D is not produced. Similarly reflected rays 67D are not produced to correspond to reflected rays 67 with the result that image 87D is not produced. As such, the width of the reflecting surface affects how long, during a day, projected images 83, 87 are produced.

ADDITIONAL EMBODIMENTS—FIG. 1, FIG. 2A, FIG. 3, FIG. 4

Referring to FIG. 1: An aspect of the present invention is that control is afforded to the architectural designer over several characteristics of projected image 85.

Characteristics include brightness, sharpness, size, trajectory, effective period, and speed of traversal.

Design considerations that affect these several characteristics include:

- the material, size, and shape of reflecting surface 30;
- the orientation of reflecting surface 30 relative to sun 15;
- the distance from the reflecting surface 30 to gnomon 50;
- the distance from the gnomon 50 to dial 70;
- the positioning of gnomon 50 relative to reflecting surface 30;
- the position of of dial 70 relative to gnomon 50.

The architectural designer, when comparing similar embodiments, will realize from an understanding of the geometry and optics:

- An embodiment that increases the size of reflecting surface 30 may result in a longer effective period whereas an embodiment that decreases the size of reflecting surface 30 may result in a sharper projected image 85.
- An embodiment with reflecting surface 30 closer to dial 70, may result in a longer effective period, a brighter projected image 85, slower movement of projected image 85 across dial 70, and a smaller projected image 85.
- An embodiment with gnomon 50 closer to reflecting surface 30 may result in a shorter effective period, faster movement of projected image 85 across dial 70, a less sharp projected image 85, and a larger projected image 85.
- An embodiment with reflecting surface 30 of smaller convex radius or a larger concave radius may result in a longer effective period, a dimmer projected image 85, slower movement of projected image 85 across dial 70, a sharper projected image 85 and a smaller projected image size 85.

In various embodiments, reflecting surface 30 may consist of mirror, of glass, of metal, of a polished surface such as stone, of a liquid such as water (still or flowing), or other materials may be suitable. In various embodiments reflecting surface 30 may reflect light of all wavelengths, or may reflect light of certain wavelengths (colors) and not others—thus imparting a color to reflected rays 65, and thus to projected image 85.

In various embodiments, reflecting surface 30 may be flat, concave or convex, or may be a combination such as flat in one dimension and convex in another (such as a cylinder) or may be convex in one dimension and concave in another (such as saddle-shaped). Numerous other combinations exists and will be apparent to a skilled practitioner.

Gnomon 50 is an object that affects reflected rays 45, 65 such that they result in a projected image 85 onto dial 70. In some embodiments, gnomon 50 is the edge between an opaque portion of an object and a transparent or an open portion of the object. In some other embodiments, gnomon 50 is an opaque wire in the path of reflected rays 45, 65, such that the shadow of the wire onto dial 70 is observable on dial 70 as projected image 85. In other embodiments, gnomon 50 is an open slot in an otherwise opaque surface positioned in the path of reflected rays 45, 65 such that the reflected rays 65 which proceed through the open slot proceed to dial 70 and form projected image 85. In other embodiments, gnomon 50 is a transparent portion of an otherwise opaque surface positioned in the path of reflected rays 45, 65 such that the reflected rays 65 which proceed through the open slot proceed to dial 70 and form projected image 85. In other embodiments, gnomon 50 is an image that is projected onto dial 70. In other embodiments, gnomon 50 is an image produced by stenciled artwork. In other embodiments, gnomon 50 is an image produced by a photographic slide or negative. In other embodiments, gnomon 50 is an image produced by a mask. In other embodiments, gnomon 50 is an image produced by stained glass. A skilled practitioner will see that there are other means of producing this artwork as gnomon 50. In other embodiments, gnomon 50 is an architectural or structural feature that serves purposes unrelated to this invention. For example, in some embodiments, gnomon 50 is a post or other structural component of a building. In other embodiments, gnomon 50 is part of the framing associated with a window.

In all of these embodiments, projected image 85 is the result of reflected rays 45, 65 interacting with gnomon 50 such that some rays 65 proceed to dial 70 while other rays 45 are blocked or otherwise affected by gnomon 50. In various embodiments, gnomon 50 may affect these rays 45 by blocking them entirely, or by altering their intensity, or by altering their color. A skilled practitioner will see that there are other means of blocking or altering reflected rays 45, 65.

Dial 70 is a surface onto which the projected image 85 is visible. In some embodiments, dial 70 is a wall. In other embodiments, dial 70 is a translucent surface such as a window or a screen such that projected image 85 is visible from one side or the other or both sides. In other embodiments, dial 70 is a substantially horizontal surface such as a ceiling, floor, lawn or pavement. In other embodiments, dial 70 is a series of surfaces. In some embodiments, dial 70 is a plurality of non-flat surfaces such as posts or sculptures. In some embodiments, dial 70 contains indicia, in other embodiments dial 70 does not contain indicia. In some embodiments in which there are indicia, dial 70 may include indicia associated with different gnomons 50 and/or reflecting surfaces 30. In other embodiments, the indicia associated with a single reflecting surface 30 and gnomon 50 may appear on a plurality of dials 70.

Some embodiments include plurality of reflecting surfaces 30, plurality of gnomons 50, plurality of dials 70, and combinations thereof. For example, an embodiment with a single reflecting surface 30, may have multiple gnomons 50; with each gnomon being effective at a different time of day—or different time of year. In another example, a single gnomon 50 is associated with multiple reflecting surfaces 30, such that each reflecting surface is effective at a different time of day—or a different time of year. In the first example, projected images 85 will typically have more separation from each other, while the second example provides the architectural designer with the means to lessen the separation between plurality of projected images 85. In each of these examples, the plurality of projected images 85 may be displayed on a single dial 70 or on a plurality of dials 70. A skilled practitioner will recognize other ways in which a plurality of reflecting surfaces 30 may interact with a plurality of gnomons 50 and a plurality of dials 70.

Figure 3:
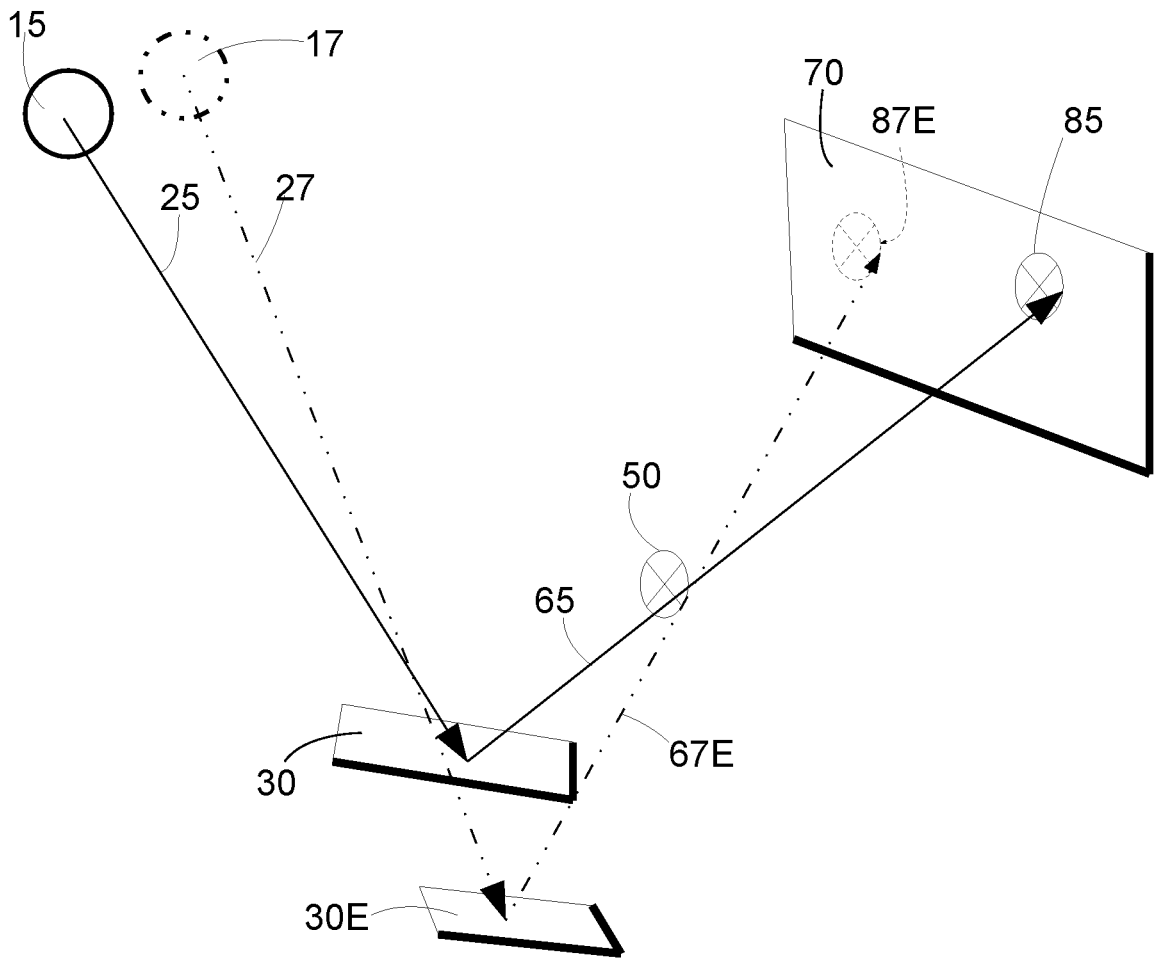
FIG. 3 is an additional embodiment with two reflecting surfaces.

FIG. 3 illustrates an embodiment with two reflecting surfaces. Much of the apparatus is identical to that as shown in the other Figs—including FIG. 2A and FIG. 2D. However, FIG. 3 illustrates an additional reflecting surface 30E that is fixed at a slightly different orientation than reflecting surface 30 of FIG. 2A. Incident rays 27 from sun at a later instant 17 are reflected by additional reflecting surface 30E such that the reflected rays 67E interact with gnomon 50 and produce projected image 87E on dial 70. In some embodiments, the effective period of reflecting surface 30 may be chosen to supplement the effective period of reflecting surface 30E. As way of example, the architectural designer may choose the effective period of reflecting surface 30 to be for an hour around local noon, and may choose the effective period of reflecting surface 30E to be one hour later. Although the FIG. 3 illustrates an embodiment with two reflecting surfaces, a skilled practitioner can extrapolate to any number of reflecting surfaces.

Figure 4:
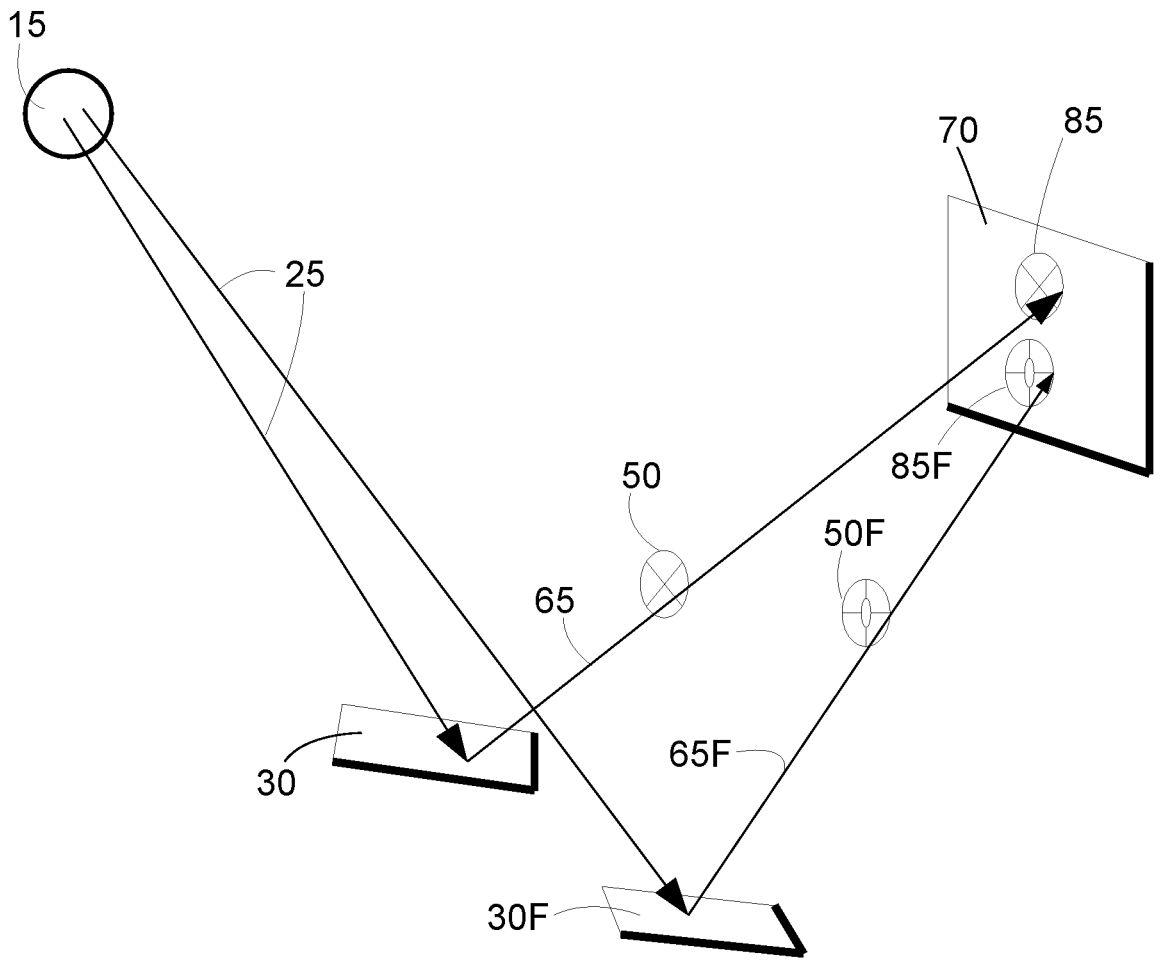
FIG. 4 is an additional embodiment two reflecting surfaces and two gnomons.

FIG. 4 illustrates an embodiment with two reflecting surfaces and two gnomons. Much of the apparatus is identical to that as shown in the other Figs—including FIG. 2A, FIG. 2D, and FIG. 3. However, FIG. 4 illustrates an additional reflecting surface 30F and an additional gnomon 50F. In this embodiment, the orientation of additional reflecting surface 30F causes its reflected rays 65F to interact with additional gnomon 50F to produce an additional projected image 85F on dial 70 simultaneously with projected image 85. Thus, an observer would see both projected images simultaneously. Related embodiments cause additional projected image 85F to interact with projected image 85.

For example, colors from projected images 85 and 85F would additively blend. Although the FIG. 4 illustrates an embodiment with two reflecting surfaces and two gnomons, a skilled practitioner can extrapolate to any number of reflecting surfaces and any number of gnomons.

Referring to FIG. 2A, for a northern hemisphere installation, some embodiments are arranged so that the plurality of gnomons 50 are north of reflecting surfaces 30. And the plurality of dials 70 are north of the plurality of gnomons 50.

Referring to FIG. 1, for a northern hemisphere installation, other embodiments are arranged so that plurality of gnomons 50 are south of plurality of reflecting surfaces 30.

And plurality of dials 70 are south of the plurality of gnomons 50. In these embodiments, the incident rays 25 from sun 15 passes above the plurality of dials 70 on their way to the plurality of reflecting surfaces 30. A skilled architectural designer will understand that other orientations are possible. In another embodiment, the plurality of the reflecting surfaces 30 is to the east of the plurality of dials 70. In another embodiment, the plurality of reflecting surfaces 30 is to the west of the plurality of dials 70. In another embodiment, a plurality of reflecting surfaces 30 are arranged each with different orientations to the plurality of dials 70—some surfaces to the east, others to the west, others to the north, others to the south.

Advantages

From the description above, a number of advantages of some embodiments of my reflected sundial becomes evident:

(a) A projected image may be positioned on an architectural work at some distance from the gnomon, such that the projected image's movement imparts observers with some visual interest and some indication of time of day, or day of year.

(b) The projected image may be artwork of arbitrary design and complexity.

(c) Various aspects of the projected image can be controlled by the architectural designer. In addition to the image itself, aspects include brightness, sharpness, size, effective period, rate of movement throughout the day and throughout the year, and trajectory throughout the day and throughout the year.

(d) Various components may be architectural elements that serve other purposes in the architectural work. For examples, windows may be utilized as reflecting elements, as could sculptures or ponds.

(e) The reflecting surface may be hidden to some degree from the observer. Thus the observer would see the projected image on an architectural feature, but would not see the source of the light. Or contrarily, the reflecting surface may itself be a prominent architectural feature, such as a pond or a sculpture or glass work.

(f) The gnomon may be hidden to some degree from the observer. Thus the observer will see the projected image on an architectural feature, but would not see the source of the image. Or contrarily, the gnomon may itself be a prominent architectural feature, such as a sculpture or stenciling on a window.

(g) Multiple images may be projected simultaneously, by using a plurality of reflecting surfaces and a plurality of gnomons. These images may have different colors, and they may have different trajectories. A skilled architectural designer can cause these different images to interact. For example, two images having different colors may align at some point in time, in which case the colors of the projected images will blend into a different color.

(h) Multiple images may be projected at different times—including time of day or day of the year. Thus, one image could be projected onto a specific architectural feature at some time of the morning, and a unique image could be projected onto the same specific architectural feature in the afternoon.

(i) Affords architectural designers with nearly limitless possibilities of where and how to project images onto various architectural features. The images could be projected sequentially or simultaneously, different images could be projected at different times of day, or different times of the year, different images could have different trajectories and different rates of movements, different objects can interact visually—blending colors or blending artistic elements to combine into a superset pattern.

Other advantages of one or more aspects will be apparent from a consideration of the drawing and the preceding description.

CONCLUSION, RAMIFICATIONS AND SCOPE

Accordingly, the reader will see that reflecting sundials of the various embodiments can be used to add visual interest to an architectural work. An image may be projected to an easily viewable architectural feature, with the image being of arbitrary design and complexity. An architectural designer may select an appropriate embodiment to optimize characteristics of this image including color, brightness, sharpness, size, trajectory, effective period and rate of movement.

Although the description above contains many specifics, these should not be construed as limiting the scope of the embodiments but as merely providing illustrations of some of several embodiments. For example, the reflecting surface may be of materials other than listed; and the combinations of reflecting surfaces, gnomons and dials may be other than listed.

Thus the scope of embodiments should be determined by the appended claims and their legal equivalents, rather than by the examples given.

The invention claimed is:

1. An apparatus for projecting a plurality of images onto an architectural work using reflected rays from the sun or moon, comprising (a) a plurality of reflecting surfaces positioned to be directly exposed to the sun's or moon's rays, (b) a plurality of gnomons positioned to be directly exposed to the reflected rays from said reflecting surfaces, and (c) a plurality of dials positioned to capture the image created by the projection of said reflected rays on said gnomon, wherein said reflecting surfaces, gnomons and dials are positioned such that, for at least an instant a year, the sun's or moon's rays striking on said reflecting surface are reflected toward said dial, such that some of the reflected rays interact with said gnomon, resulting in an image created by this interaction being projected onto said dials, whereby said image moves across said dial in response to movement of the sun or moon across the sky.

2. The apparatus of claim 1 wherein said dial is a wall or other architectural feature.

3. The apparatus of claim 1 wherein said gnomon comprises at least one of a sculpture, artwork, an architectural feature.

4. The apparatus of claim 1 wherein said reflecting surface is an architectural feature.

5. The apparatus of claim 1 wherein said dial contains indicia to indicate time of day.

6. The apparatus of claim 1 wherein said dial contains indicia to indicate day of year.

7. The apparatus of claim 1 wherein said reflecting surface is concave in at least one dimension.

8. The apparatus of claim 1 wherein said reflecting surface is convex in at least one dimension.

9. A method of projecting an image on a dial using reflected light from the sun or moon, comprising the steps of (a) providing a plurality of reflecting surfaces positioned to reflect light from the sun or moon, (b) a plurality of gnomons positioned positioned in the path of the reflected rays from said reflecting surfaces for at least an instant during the year, and (c) providing a plurality of dials positioned to capture the projected image, wherein said reflecting surfaces, gnomons and dials are positioned such that, for at least an instant a year, reflected rays produced by the reflection of the sun's or moon's rays on said reflecting surfaces are directed toward said gnomons such that the interaction of the reflected rays with said gnomons produces said images upon said dials, whereby said image moves across said dial in response to movement of said sun or moon across the sky.

10. The method of claim 9 wherein said dial is a wall or other architectural feature.

11. The method of claim 9 wherein said gnomon comprises at least one of a sculpture, artwork, an architectural feature.

12. The method of claim 9 wherein said reflecting surface is an architectural feature.

13. The method of claim 9 wherein said dial contains indicia to indicate time of day.

14. The method of claim 9 wherein said dial contains indicia to indicate day of year.

15. The method of claim 9 wherein said reflecting surfaces is concave in at least one dimension.

16. The method of claim 9 wherein said reflecting surfaces is convex in at least one dimension.

* * * * *